United States Patent [19]

Karashima

[11] Patent Number: 4,760,708

[45] Date of Patent: Aug. 2, 1988

[54] REFRIGERATED SHOWCASE

[76] Inventor: Masashi Karashima, 88-5, Nakano, Ebina-shi, Kanagawa-ken, Japan

[21] Appl. No.: 10,840

[22] Filed: Feb. 2, 1987

[30] Foreign Application Priority Data

Oct. 29, 1986 [JP] Japan ..... 61-255769

[51] Int. Cl.[4] ..... A47F 3/04

[52] U.S. Cl. ..... 62/256; 62/255

[58] Field of Search ..... 62/256, 255

[56] References Cited

U.S. PATENT DOCUMENTS 3,063,255 11/1962 Fanick, Jr. et al. ..... 62/256
3,125,864 3/1964 Ural ..... 62/255 X
3,218,822 11/1965 Bentley et al. ..... 62/256
3,584,467 6/1971 Barroero ..... 62/256 X
3,827,254 8/1974 MacMaster et al. ..... 62/256
4,592,209 6/1986 Casanova et al. ..... 62/256 X

*Primary Examiner*—William E. Tapolcai
*Attorney, Agent, or Firm*—Wenderoth, Lind & Ponack

[57] ABSTRACT

A refrigerated showcase in which refrigerated air for refrigerating the interior of the showcase and preventing ambient air from invading in the showcase is circulated across a front opening of the showcase and through a bottom wall, a rear wall and a top wall of the showcase, is improved according to the present invention. The improvements reside in that a gas-permeable spacer is disposed at the end of shelves within the showcase and spaced from the front surface of the rear wall to form a refrigerated air introducing duct space between the spacer and the rear wall.

4 Claims, 7 Drawing Sheets

REFRIGERATED SHOWCASE

BACKGROUND OF THE INVENTION

The present invention relates to improvements in a refrigerated showcase that is used in a supermarket or the like.

In a heretofore known refrigerated showcase shown in FIGS. 1 and 2, a refrigerator (3) and a fan (4) are contained within a duct (2) for circulating refrigerated air to refrigerate fresh and/or refrigerated goods displayed in the showcase, which duct is provided in the bottom wall (1) of the showcase. The front end of the duct (2) communicates with an intake port (5) at the bottom edge of a front opening of the showcase, and the rear end of the duct (2) extends vertically in the rear wall (6) of the showcase, further extends through the top wall (7) of the showcase and communicates with a blow-out port (8) at the top edge of the front opening of the showcase.

Outside of and extending parallel to the duct (2) are ducts (2') and (2'') for circulating cold air to prevent a temperature rise in the refrigerated air for refrigerating the fresh and/or refrigerated goods displayed in the showcase. The front ends of the respective ducts (2') and (2'') communicate with intake ports (5') and (5'') at the bottom edge of the front opening of the showcase, the rear ends of the ducts (2') and (2'') extend through the rear wall (6) of the showcase and the top wall (7) of the showcase and communicate with blow-out ports (8') and (8'') at the top edge of the front opening of the showcase, and fans (9) and (10) are provided within the respective ducts (2') and (2'').

Accordingly, the refrigerated air for refrigerating the interior of the showcase, which has been sucked into the duct (2) by the fan (4) and refrigerated by the refrigerator (3), passes through the duct (2) provided in the bottom wall (1), rear wall (6) and top wall (7) of the showcase, then it is blown out of the blow-out port (8) at the top edge of the front opening of the showcase and sucked into the intake port (5) at the bottom edge of the front opening, and while the refrigerated air circulates across the front opening of the showcase and through the rear wall (6) and top wall (7) of the showcase, it refrigerates the fresh and/or refrigerated goods (12) placed on shelves (11) within the showcase and on the bottom wall (1).

On the other hand, the air sucked into the ducts (2') and (2'') through the intake ports (5') and (5'') at the bottom edge of the front opening by the fans (9) and (10), is cooled by the refrigerator (3) and the refrigerated air in the duct (2) while it flows through the bottom wall (1), rear wall (6) and top wall (7), is then blown out of the blow-out ports (8') and (8'') at the top edge of the front opening of the showcase, and forms a low-temperature air curtain outside of the flow of the refrigerated air for refrigerating the interior of the showcase at the front opening of the showcase so that the refrigerated air for refrigerating the interior of the showcase does not come into direct contact with the ambient air and rise in temperature.

However, even if the invasion of the ambient air into the showcase is prevented by the above-described air curtain, the ambient air would mix with the air curtain and the refrigerated air for refrigerating the interior of the showcase as shown by arrows A, and thereby the refrigerating effect is degraded at the lower shelves in the showcase as compared to the higher shelves.

In order to prevent such degradation of the refrigerating effect in the lower portion of the showcase, as shown in FIG. 3, a somewhat improved refrigerated showcase was proposed in which refrigerated air blow-out ports (13) are open in the rear wall (6) of the showcase to introduce the refrigerated air directly into the interior of the showcase. In FIG. 3, component parts which are equivalent to those provided in the refrigerated showcase shown in FIGS. 1 and 2, are given like reference numerals.

However, in the last-mentioned improved case, although the refrigerating effect for the interior of the showcase is improved, upon defrosting the refrigerator (3), the air at an elevated temperature would invade the interior of the showcase through the above-mentioned blow-out ports (13) as shown by arrows B, and would come into direct contact with the fresh and/or refrigerated goods (12), resulting in deterioration of the quality of the goods. In FIG. 4 which shows a defrosting state of the same refrigerated showcase, reference numeral (14) designates a heater in an operating state.

SUMMARY OF THE INVENTION

It is therefore one object of the present invention to provide an improved refrigerated showcase which is free from the above-mentioned shortcomings of the refrigerated showcases in the prior art.

According to one feature of the present invention, there is provided a refrigerated showcase in which refrigerated air for refrigerating the interior of the showcase and preventing ambient air from invading the showcase is circulated across a front opening of the showcase and through a bottom wall, a rear wall and a top wall of the showcase, and in which a gas-permeable spacer is disposed at the rear of shelves within the showcase and spaced from the front surface of the rear wall to form a refrigerated air introducing duct space between the spacer and the rear wall.

According to the present invention, since the refrigerated showcase is constructed in the above-described manner, a part of the refrigerated air for refrigerating the interior of the showcase that is blown out of the blow-out port at the top edge of the front opening of the showcase advances into the refrigerated air introducing duct space formed between the gas-permeable spacer and the rear wall and flows downwards. At this moment, the refrigerated air flowing down through the duct space permeates through the gas-permeable spacer and flows onto the upper surfaces of the respective shelves, and thereby the goods displayed on the respective shelves are wrapped in the refrigerated air. Moreover, in association with the fact that the refrigerated air flowing down through the above-mentioned duct space does not mix with the ambient air and hence would not be subjected to a temperature rise, the goods displayed on the respective shelves, especially the goods displayed in the lower portion of the showcase, can be refrigerated effectively.

In addition, according to the present invention, upon defrosting, the air heated up to a raised temperature flows through the duct in the showcase and is prevented from invading the interior of the showcase, and hence the heated air does not come into direct contact with the goods on the shelves and would not deteriorate the quality of the goods.

In summary, in the refrigerated showcase according to the present invention, due to the fact that air-permeable spacer is disposed at the rear of the shelves within the showcase and is spaced from the front surface of the rear wall, the refrigerating effect for the goods within the showcase can be enhanced, and deterioration of the quality of the goods within the showcase upon defrosting can be prevented.

BRIEF DESCRIPTION OF THE DRAWINGS

The above-mentioned and other objects, features and advantages of the present invention will become more apparent upon a perusal of the following specification taken in conjunction with the accompanying drawings, wherein.

DESCRIPTION OF THE PREFERRED EMBODIMENT

Figure 1:
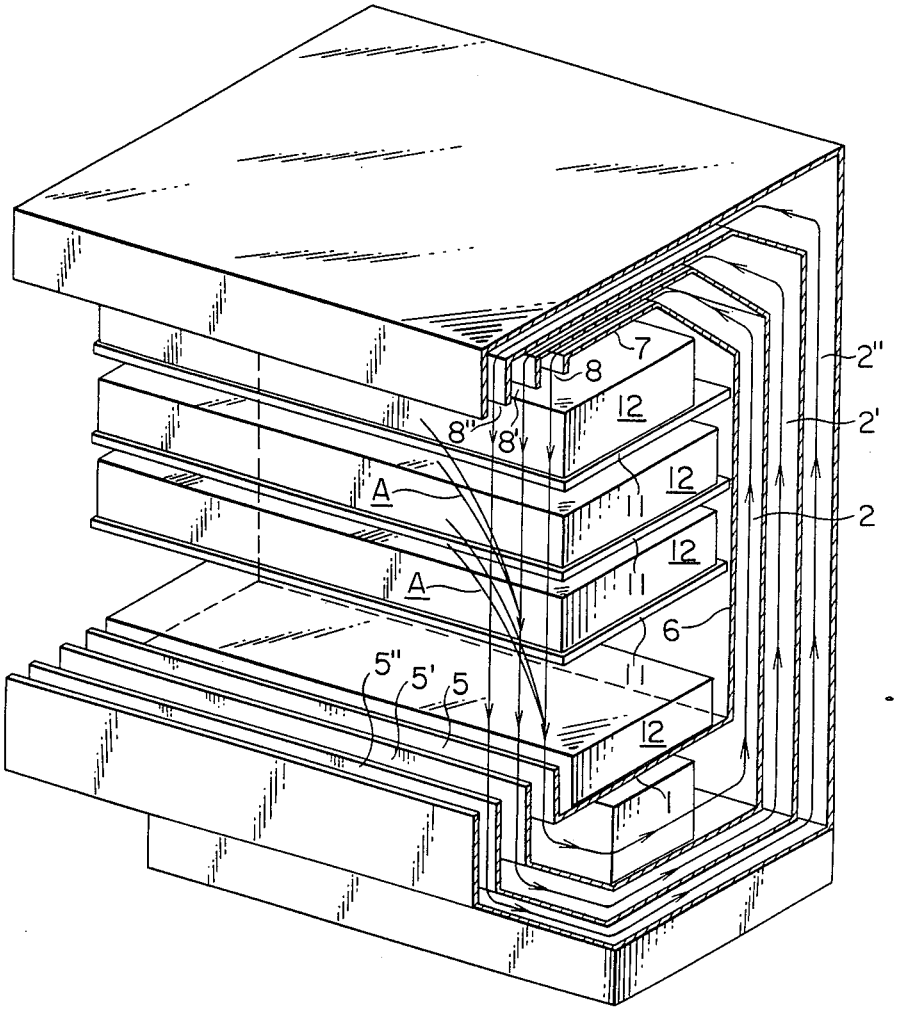
FIG. 1 PRIOR ART
FIG. 1 is a perspective view, partly in longitudinal cross-section, showing one example of the refrigerated showcases in the prior art.
Figure 2:
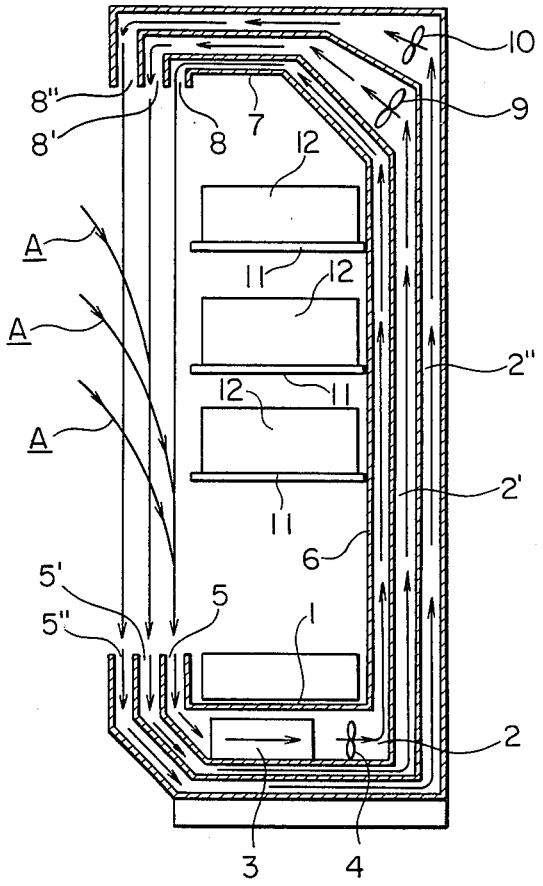
FIG. 2 PRIOR ART
FIG. 2 is a longitudinal cross-sectional side view of the same.
Figure 3:
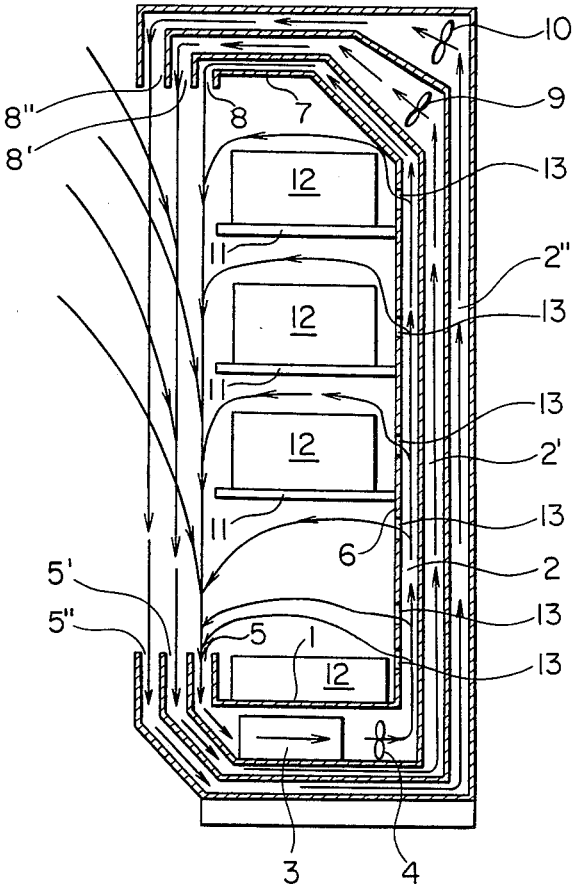
FIG. 3 PRIOR ART
FIG. 3 is a longitudinal cross-sectional side view showing another example of the refrigerated showcases of the prior art.
Figure 4:
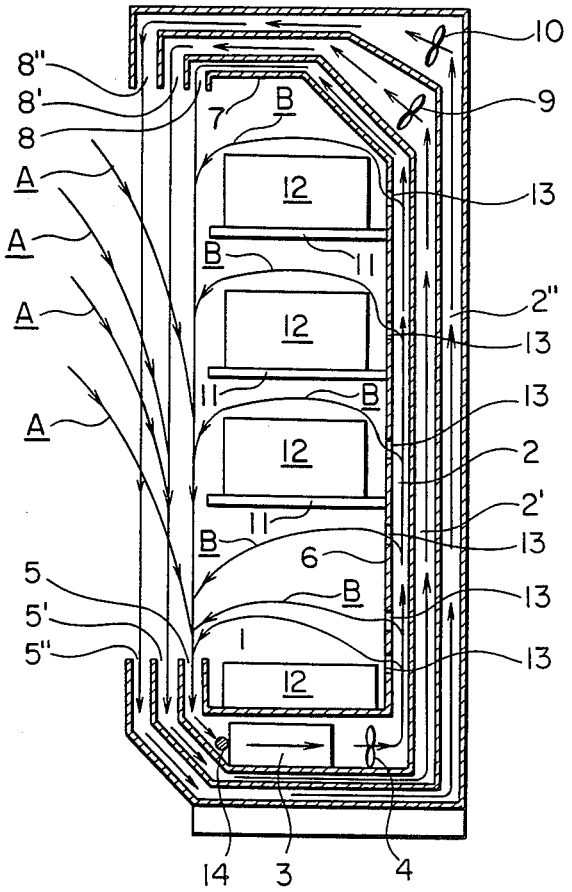
FIG. 4 PRIOR ART
FIG. 4 is a longitudinal cross-sectional side view showing the same in a defrosting state.

Now one preferred embodiment of the present invention will be described with reference to FIGS. 5 to 7, wherein component parts which are equivalent to those of the refrigerated showcase in the prior art as illustrated in FIGS. 1 to 4 are given like reference numerals.

Figure 5:
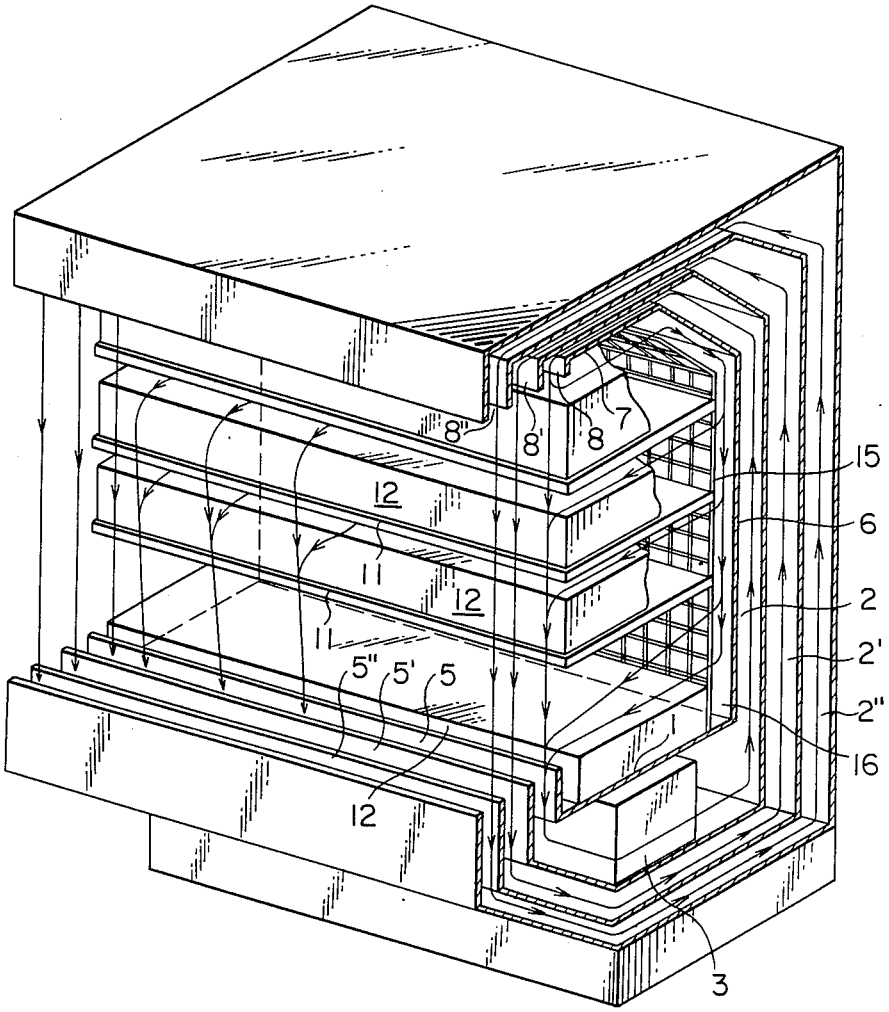
FIG. 5 is a perspective view, partly in longitudinal cross-section, of one preferred embodiment of the refrigerated showcase according to the present invention.
Figure 7:
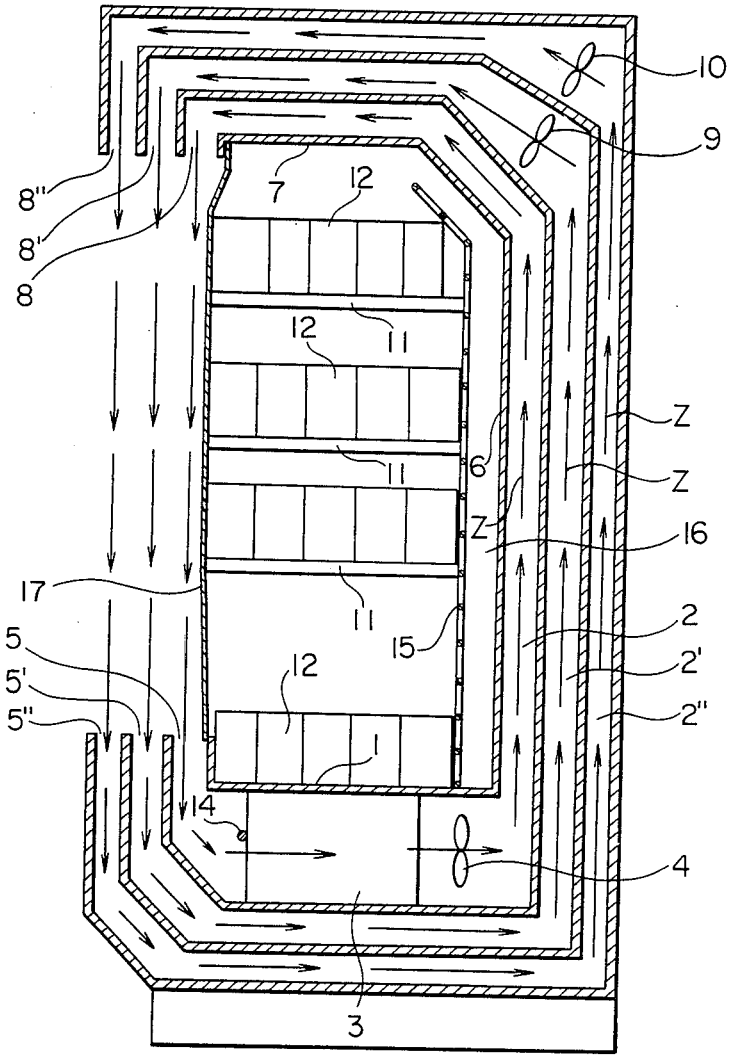
FIG. 7 is a longitudinal cross-sectional view showing the same in a defrosting state.

As shown in FIGS. 5 and 7, a gas-permeable spacer (15) is disposed vertically at the rear of the shelves in the showcase and is spaced from the front surface of a rear wall (6) of the showcase, and thus, a refrigerated air introducing duct space (16) is formed between the spacer (15) and the rear wall (6).

While the gas-permeable spacer (15) is formed of a network body in which metal rods or synthetic resin rods are arrayed in a lattice form in the illustrated embodiment, it could be formed of a perforated plate or a fibrous fabric.

Figure 6:
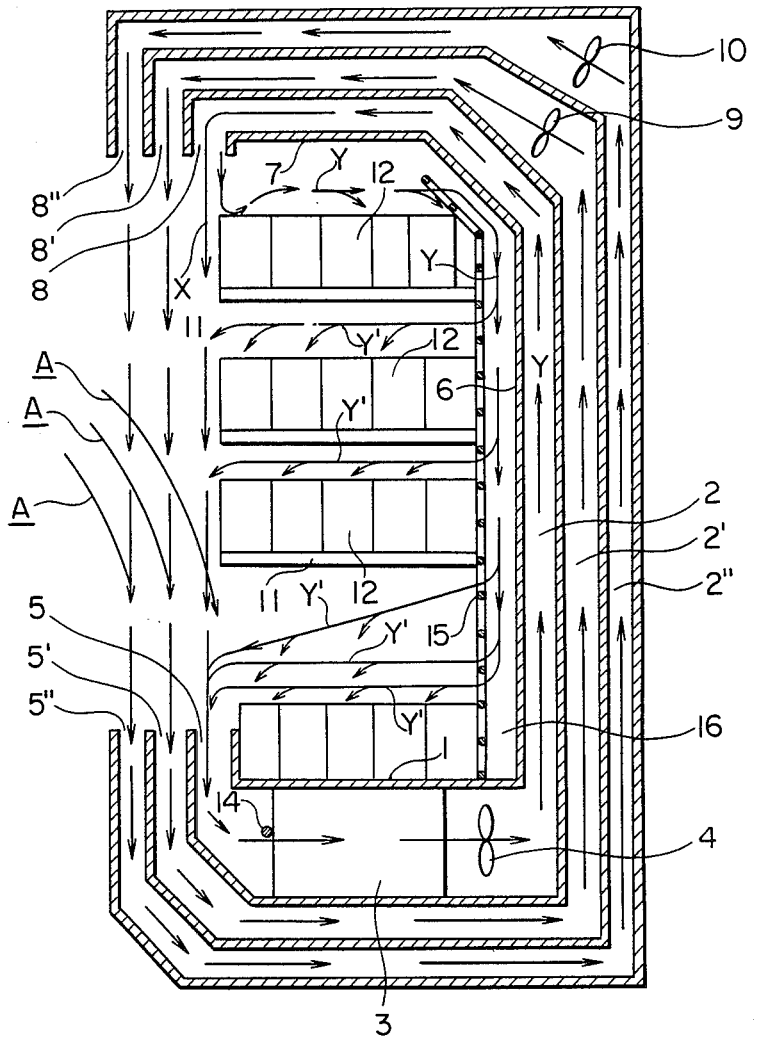
FIG. 6 is a longitudinal cross-sectional view of the same.

Since the illustrated embodiment is constructed as described above, refrigerated air for refrigerating the interior of the showcase, which was sucked into a duct (2) provided in a bottom wall (1), a rear wall (6) and a top wall (7) of the showcase by a fan (4), is blown out of a blow-out port (8) at the top edge of a front opening of the showcase, part of the refrigerated air flows straightly towards an intake port (5) at the bottom edge of the front opening of the showcase to form an air curtain as shown by arrows X in FIG. 6, but another part of the refrigerated air flows along the top surface of the uppermost shelf (11) or goods (12) on the same shelf (11), then advances into a refrigerated air introducing duct space (16) formed between the gas-permeable spacer (15) and the rear wall (6) and flows down through the same space (16) to the lowermost portion, as shown by arrows Y.

While the refrigerated air for cooling the interior of the showcase flows down through the above-mentioned space (16), part of the refrigerated air penetrates through the gas-permeable spacer (15) and then flows along the top surfaces of the respective shelves (11) or goods (12) on the respective shelves, as shown by arrows Y'.

Accordingly, the goods on the respective shelves (11) have their outer peripheral surfaces wrapped in the refrigerated air for refrigerating the interior of the showcase, and in association with the fact that the refrigerated air flowing down through the space (16) is not nearly subject to a temperature rise because it does not mix with the ambient air, the goods on the respective shelves (11) in the showcase, especially the goods on the lowermost shelf (11) can be refrigerated effectively.

It is to be noted that although the front faces of the shelves are positioned generally at the rear of a plane extending between the blow-out port and the intake port of the refrigerated air for refrigerating the interior of the showcase so that the air curtain formed of the refrigerated air is not be broken by the shelves, in the illustrated embodiment, the depth of the blow-out port (8) of the refrigerated air is made larger to make the thickness of the air curtain thicker so that the rear portion of the same air curtain may collide with the shelves, and thereby the refrigerated air for refrigerating the interior of the showcase can be introduced more smoothly into the refrigerated air introducing duct space (16) at the rear of the showcase without breaking the air curtain across the front opening of the refrigerated showcase.

Upon defrosting, the front opening of the goods displaying space within the showcase is covered by a cover (17) after the super market where the refrigerated showcase is equipped is closed, then air at a raised temperature is introduced into the respective ducts (2), (2') and (2'') and is circulated therethrough. At this time, the air at the raised temperature does not come into direct contact with the goods (12) on the shelves (11), and therefore, the quality of the goods (12) is not deteriorated.

Since many changes could be made in the above-described construction, and many of them apparently widely different without departing from the scope thereof, it is intended that all matter contained in the above description or shown in the accompanying drawings shall be interpreted as illustrative and not as limiting.

What is claimed is:

1. A refrigerated showcase for circulating refrigerated air to refrigerate goods displayed therein and for preventing ambient air from flowing therein, said showcase comprising:

a front wall having an opening extending therethrough open to the ambient air, said front wall comprising a duct, a first portion of the duct having an intake port open to said opening through which ambient air is introduced into the duct, and a second portion of the duct having a blow-out port open to said opening and disposed across said opening from said intake port;

a bottom wall extending from said front wall, said bottom wall comprising a duct open to and extending from said first portion of the duct of which the front wall is comprised so as to be continuous therewith;

a rear wall extending from said bottom wall and spaced from said front wall;

said rear wall comprising a duct open to and extending from the duct of which said bottom wall is comprised so as to be continuous therewith, a top wall extending from said rear wall to said front wall, said top wall comprising a duct open to and extending between the duct of which said rear wall is comprised and said second portion of the duct of which said front wall is comprised such that a continuous flow path extends in a direction from said intake port through said front wall, said bottom wall, said rear wall, and said top wall to said blow-out port and across said opening;

a gas-permeable spacer extending in said display space and spaced from the duct of which said rear wall is comprised so as to define a refrigerated air introducing space therebetween that is separated from but open to said continuous flow path, said spacer also spaced from said front wall so as to define a display space therebetween in which the goods are displayed; and air circulating means for circulating refrigerating air along said continuous flow path and into said air introducing space from said continuous flow path so that the refrigerating air permeates said gas-permeable spacer and flows into said display space, said air circulating means including a shelf extending from said gas-permeable spacer toward said opening extending through said front wall and into the portion of the continuous flow path that extends across said opening for deflecting a portion of the refrigerating air circulating along the continuous flow path into said refrigerated air introducing space.

2. A refrigerated showcase as claimed in claim 1, wherein said gas-permeable spacer is a network body.

3. A refrigerated showcase as claimed in claim 1, wherein said gas-permeable spacer is a perforated plate.

4. A refrigerated showcase as claimed in claim 1, wherein said gas-permeable spacer is a fibrous fabric.

* * * * *